US009126079B2

(12) United States Patent
Jordan

(10) Patent No.: US 9,126,079 B2
(45) Date of Patent: Sep. 8, 2015

(54) ADAPTER FOR EXERCISE BAR

(76) Inventor: Edward M. Jordan, Fort Lauderdale, FL (US)

( * ) Notice: Subject to any disclaimer, the term of this patent is extended or adjusted under 35 U.S.C. 154(b) by 462 days.

(21) Appl. No.: 13/547,609

(22) Filed: Jul. 12, 2012

(65) Prior Publication Data

US 2014/0018214 A1 Jan. 16, 2014

(51) Int. Cl.
*A63B 23/12* (2006.01)
*A63B 21/072* (2006.01)

(52) U.S. Cl.
CPC ..... *A63B 21/072* (2013.01); *A63B 23/12* (2013.01); *A63B 21/0728* (2013.01); *A63B 2021/0722* (2013.01)

(58) Field of Classification Search
CPC .. A63B 21/0004; A63B 21/06; A63B 21/072; A63B 21/075; A63B 2021/0722
USPC ..... 482/92, 93, 106, 107, 108, 908
See application file for complete search history.

(56) References Cited

U.S. PATENT DOCUMENTS 1,366,200 A * 1/1921 Matysek ..... 482/106
4,252,316 A 2/1981 Price
4,482,151 A 11/1984 Zwilling
4,872,667 A 10/1989 Favot
RE33,218 E 5/1990 Twardosz
4,973,043 A 11/1990 Nolan
5,221,244 A 6/1993 Doss
5,496,243 A 3/1996 Allen
5,775,756 A 7/1998 Rozenich
7,081,072 B2 7/2006 Allen
7,201,711 B2 4/2007 Towley, III et al.
7,326,155 B2 2/2008 Kim
7,789,814 B1 * 9/2010 Xu ..... 482/107
8,033,964 B1 * 10/2011 Chen ..... 482/106
8,337,372 B1 * 12/2012 Boterenbrood ..... 482/139

* cited by examiner

*Primary Examiner* — Loan H Thanh
*Assistant Examiner* — Sundhara Ganesan
(74) *Attorney, Agent, or Firm* — Woods Oviatt Gilman LLP; Dennis B. Danella, Esq.

(57) ABSTRACT

A dumbbell mounting assembly for releasably mounting a dumbbell on a bar is provided. The assembly comprises a sleeve including a first end and a second end, wherein the first end has a cap, and a second end is configured for receiving the bar. The assembly also includes a generally J-shaped bracket pivotally mounted to the cap and adapted to secure the dumbbell in the bracket. A method for releasably mounting the dumbbell on a bar using the assembly is also provided.

21 Claims, 2 Drawing Sheets

ADAPTER FOR EXERCISE BAR

FIELD OF THE INVENTION

The present invention relates to an adapter for an exercise bar that allows for the interchangeability of a pair of dumbbells releasably secured at either end of the bar. More particularly, the present invention relates to a two piece adapter assembly comprising a sleeve for mounting the assembly on the bar and a bracket pivotally secured to the sleeve for holding a weight, such as a dumbbell. The bracket is generally J-shaped and forms a cradle for releasably securing a dumbbell within the cradle. The bracket is further equipped with a fastener for securing the dumbbell in the bracket.

BACKGROUND OF THE INVENTION

The developing epidemic of obesity, and the numerous adverse health conditions and increased health risks associated with being overweight, has generated a renewed interest in improving health and fitness. An important aspect of any fitness training regimen is strength and weight training. Strength and weight training develops the size and strength of muscles, but also improves cardiovascular functioning, promotes fat loss, and improves bone and joint strength. Basic strength and weight training uses the force of gravity acting on a weight to increase muscle strength. This weight may be supplied by specialized equipment or by the body itself. Training generally involves repetitive manipulation of the weight (reps) conducted in a number of sets. For example, one set of an exercise may consist of 10 reps. A trainee may then choose to complete 3 sets of 10 reps (30 total) with a slight rest taken between sets.

Specialized equipment has been developed for use in strength and weight training. This equipment can generally be segregated into two main types—free weights and weight machines. Strength training using free weights utilizes bars, barbells, weight plates, dumbbells, and kettle bells to generate muscle mass through repeated lifting of weight. Beyond focusing on the target muscles, free weight exercises require a trainee to use stabilizer muscles to maintain proper form throughout the exercise. Typically and by way of example, a bench press, squat or bicep curl uses a barbell (or curling bar) with a number of weighted plates slid over the end of the bar with the lifter then lifting the weighted bar using both arms or legs, as appropriate. Alternative exercises (typically for the arms, back, and shoulders) use a set of dumbbells with one dumbbell held in each hand. The weighted dumbbell is lifted, in tandem or one arm at a time, to conduct an exercise. Thus, dumbbells work each arm individually while a barbell works both arms (or legs) simultaneously. As a result, barbell exercises require a lifter to control the weight with each side of the body thereby promoting more even strength between the right side and left side. However, as the body must maintain and control all of the additional weight, strain is placed on the joints of the body and improper form can damage joints and muscles leading to injury. Additionally, muscle fatigue during exercise may cause a trainee to slip or drop the weight which can impact the body causing severe injury. Strength and weight training using free weights is often cost prohibitive as a trainee will need to purchase at least one of a number of bars (such as a straight bar, chin-up bar and/or curling bar), a number of weighted plates, and a set of dumbbells (typically at least 8 to 12 weights).

An alternative to free weights are weight machines which have been developed to simulate the movements conducted during free weight training with the benefit of having the machine promote proper form and aid in preventing injuries associated with free weights. However, weight machines control movement of the weight thereby allowing the user to favor certain muscles over others. For instance, when conducting a squat press using a weight machine, a lifter can rely upon a dominant muscle group (e.g. the right quadriceps) to perform more of the lifting than other muscle groups (e.g. the left quadriceps). Thus, while a lifter may perform the squat using proper form, the lifter is developing more muscle strength in one area to the detriment of another. This imbalance may lead to injury during activity as the understrength muscles may not be able to handle the demands placed on those muscles during that activity, i.e. the imbalance between the muscles of the left leg and right leg require the left leg to work harder during the activity. If too much demand is made upon the muscles of the left leg, those muscles could pull or tear leading to injury. Additionally, weight machines generally only conduct one or possibly two different movements. Thus, numerous machines will have to be purchased to conduct a full body workout. In an attempt to alleviate this demand, and to make strength and weight training more accessible, a number of at-home multi-exercise weight machines have been developed which incorporate a variety of exercise movements into one apparatus. These systems are generally less expensive than their fitness-center-quality counterparts, but are still generally more expensive compared to a free weight system. The at-home systems also generally do not satisfactorily enable the quality of exercise afforded by exercise-specific weight machines or free weights thereby decreasing exercise effectiveness leading to disuse of the at-home system.

Thus, there is a need for a lower-cost alternative for strength and weight training exercise equipment that also promotes safe and satisfactory use of that equipment. One possible solution is to allow dumbbells to fulfill multiple functions during free weight training. Lifters generally purchase both weighted plates (for barbell exercises) and dumbbells for free weight training. However, systems have been developed which allow the dumbbells to replace, and function generally equivalent to, weighted plates. These systems generally employ a sleeve and holder where the sleeve slides over the end of a bar with the holder arranged to hold the dumbbell. However, these systems suffer significant setbacks. Importantly, these systems do not allow pivoting of the dumbbell during an exercise. Thus, as the bar is lifted displacing the downward force of gravity, the dumbbells at the ends of the bar cannot pivot to maintain the dumbbell in a generally parallel position with the floor. Thus, as the bar is moved (for instance during a bicep curl) the ends of the dumbbell become unbalanced relative to the bar (and therefore the lifter's arms) causing the bar to want to twist or rotate to place the ends of the dumbbells in a generally parallel plane with the floor. This twisting or rotating force may potentially cause the lifter to lose control of the bar or otherwise cause injury to the lifter as the lifter must then not only conduct the lift exercise but must also strain muscles to maintain control over the bar. Present attempts to permit pivoting of the dumbbell during the movement of the bar suffer from the setback that the sleeve will eventually become dislodged from the bar during use. This creates danger not only from the falling weight, but also from the sudden loss of weight on one end of the bar causing the weighted end to drop thereby potentially striking the lifter with both the weighted end (with the dumbbell still attached) or the non-weighted end (the now dumbbell-less bar).

As such, there is a need for a device and system that safely permits a weight lifter to combine dumbbell and bar bell exercises by pivotally mounting a bracket for cradling dumbbells onto a weight lifting bar such that the dumbbells are releasably secured within the bracket cradle without the bracket becoming dislodged from the bar during use. The present invention addresses this and other needs.

BRIEF SUMMARY OF THE INVENTION

In general, the present invention is directed to an apparatus and method for the improved weight training which allows a weight lifter to use dumbbells for both dumbbell and barbell exercises in a safe and easy manner while also decreasing expenses as the present apparatus allows for two different training regimes to be conducted with one training aid. These features and other features of the present invention will be described in more detail below.

One aspect of the present invention is directed to an apparatus and method for improved weight training. The apparatus generally comprises an adapter that connects to the end of a bar, such as a barbell or curling bar. The adapter includes a sleeve configured to slide over the end of a bar so that it is releasably secured to the bar. The adapter is equipped with a bracket that is pivotally coupled to the sleeve where the bracket cradles the handle of a dumbbell. A hook-and-loop strap may further be employed to releasably secure the dumbbell handle within the bracket. Once configured, a weight trainer can perform typical exercises using a barbell, such as bench presses and squats. The dumbbells may then be removed from the bracket to perform traditional dumbbell exercises such as bicep and tricep curls. Thus, a lifter no longer needs both barbell plates and dumbbells, but rather, can perform all of the same exercises using just dumbbells and the the adapter.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
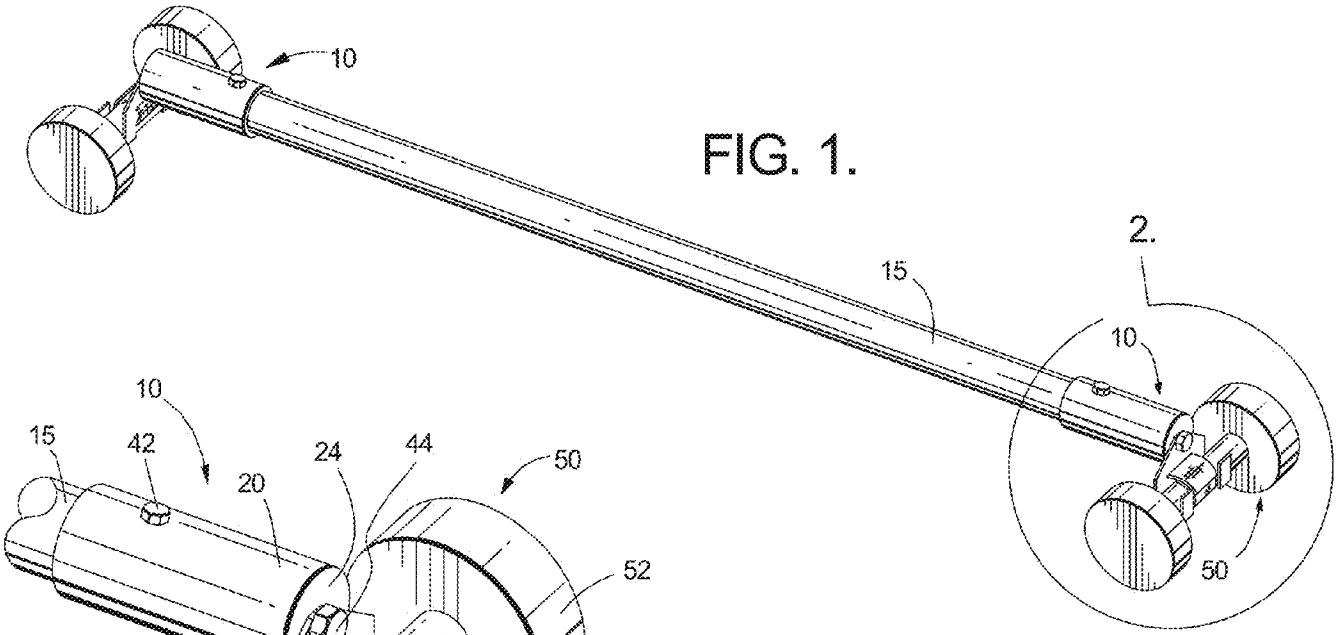
FIG. 1 is a side perspective view of one aspect of an adapter of the present invention shown attached to a bar and loaded with dumbbells.
Figure 2:
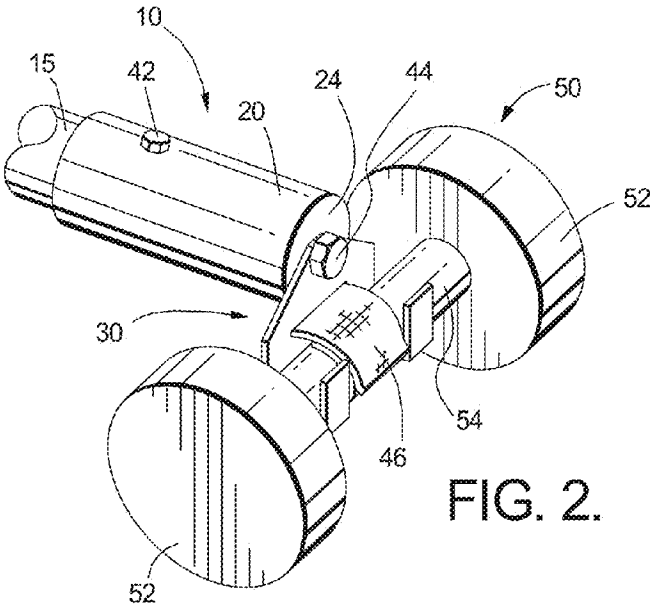
FIG. 2 is an enlarged view of the adapter shown in FIG. 1.
Figure 3:
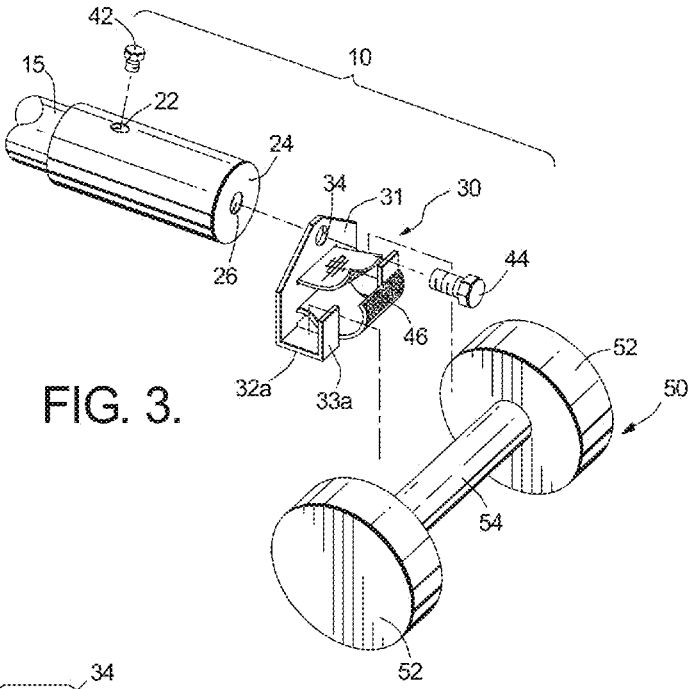
FIG. 3 is an exploded perspective view of the adapter shown in FIG. 2.

Referring to the drawings in detail, and specifically to FIGS. 1 through 3, reference numeral 10 generally designates a weight bar adapter in accordance with one aspect of the present invention. In general, adapter 10 includes a sleeve 20 which is configured to be slid over and releasably secured to bar 15, and a bracket 30 which is configured to releasably secure dumbbell 50 to sleeve 20.

As shown in greater detail in FIGS. 2 and 3, adapter 10 is a two-piece construction comprising sleeve 20 and bracket 30. Sleeve 20 is adapted to fit snuggly around bar 15 with longitudinal movement confined by an end cap 24 that may be disposed at the end of sleeve 20. In one aspect, sleeve 20 may have a sleeve hole 22 defined therein that is configured for receiving a fastening member 42, such as a threaded bolt. As seen in FIG. 3, sleeve hole 22 may have internal threads adapted to receive threaded fastening member 42. In securing sleeve 20 to bar 15, threaded fastening member 42 is screwed into sleeve hole 22 so that it comes into contact with bar 15 to apply sufficient pressure to bar 15 such that longitudinal movement of sleeve 20 relative to bar 15 is prevented. Bar 15 may optionally be configured to have a flat plane defined in its outer surface so as to mate with the distal end of threaded fastening member 42 to further prevent slippage or rotation of the sleeve on the bar.

Additionally, while shown and described as a threaded hole with a threaded bolt, bar 15 may alternatively be adapted to house a spring-loaded post (not shown) which mates with sleeve hole 22. Thus, in use, sleeve 20 is slid onto bar 15 while the spring loaded post is pressed downwardly into bar 15 until sleeve hole 22 is properly aligned with the spring loaded post. Once sleeve hole 22 is in proper alignment, the spring compression on the spring loaded post is released allowing the post to travel through sleeve hole 22 thereby securing the sleeve onto the bar. End cap 24 has a centrally located cap through-hole 26 extending through a longitudinal axis of sleeve 20, which is adapted to accept a bracket fastener 44. Cap through-hole 26 may be threaded and adapted to coordinate with complementary threads on bracket fastener 44. Also, a locking nut (not shown) located within the open interior of sleeve 20 may further coordinate with the threaded bracket fastener so that the bracket fastener 44 will not back out of the threaded hole 26 while adapter 10 is used during training exercises. In an additional aspect, bracket fastener 44 may be mounted into cap through-hole 26 through a riveted construction.

Prior to mounting bracket fastener 44 within cap through-hole 26, bracket fastener 44 passes through a bracket hole 34 defined in a back plate 31 of bracket 30. Bracket hole 34 has a nominally larger diameter than the diameter of bracket fastener 44 so that bracket 30 is able to pivot about bracket fastener 44 when mounted to sleeve 20. Bracket fastener 44 fits snuggly within bracket hole 34 so that wobbling of bracket 30 relative to sleeve 20 is minimized, but not too snuggly so as to constrict pivotal movement of bracket 30 when downward force applied to dumbbell 50 causes dumbbell 50 to pivot. Similarly, back plate 31 is snuggly secured to sleeve 20 by bracket fastener 44 so as to minimize wobbling while still permitting pivoting of bracket 30. Minimizing wobbling reduces wear and tear on bracket fastener 44, bracket hole 34 and cap through-hole 26, while also minimizing longitudinal movement of sleeve 20 along bar 15, or movement of bracket fastener 44 out of cap through-hole 26 and bracket hole 34.

Figure 4:
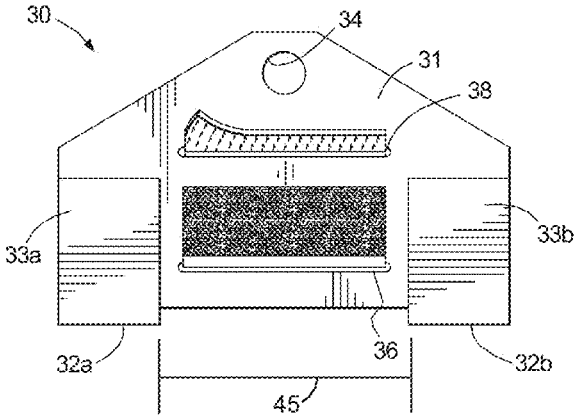
FIG. 4 is a front elevational view of a bracket shown in FIG. 3.
Figure 5:
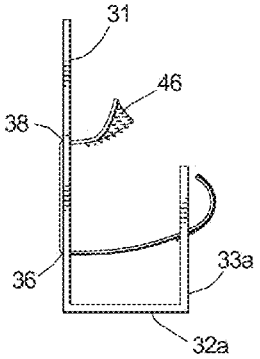
FIG. 5 is a side elevational view of the bracket shown in FIG. 4.

As best seen in FIGS. 3 through 5, bracket 30 is generally constructed as a generally J-shaped member including back plate 31, at least one base 32, and at least one upright 33. Bracket 30 is configured to receive a handle 54 of barbell 50 within the cradle formed by back plate 30, base 32, and upright 33, so that lateral movement of barbell 50 is constrained within bracket 30 by dumbbell plates 52. Thus, the only movement able to dislodge dumbbell 50 from bracket 30 is upward movement to raise dumbbell 50 over the length of upright 33. In one aspect of the present invention, back plate 31 has first and second spaced-apart bases 32*a*, 32*b* extending perpendicularly therefrom, and first and second uprights 33*a*, 33*b* extending perpendicularly from first and second bases 32*a*, 32*b*, respectively. The gap 45 formed between first and second bases 32*a*, 32*b* and uprights 33*a*, 33*b* allows a user to place dumbbell 50 within, or remove dumbbell 50 out of, the cradle of bracket 30 without pinching fingers on uprights 33*a*, 33*b*.

The gap 45 also permits a dumbbell fastener 46 to further secure dumbbell 50 within bracket 30. Dumbbell fastener 46 may be a strip of hook-and-loop material wherein a top half of the material releasably attaches to the bottom half of the material once the strip is wrapped around handle 54 of dumbbell 50. While shown and described as hook-and-loop material, other suitable fastening means can be employed, including but not limited to an adhesive, snaps, clips, buckles, magnets and buttons. Back plate 31 may further include a bottom groove 36 and a top groove 38 defined therein that are configured to allow dumbbell fastener 46 to be passed therethrough. In this arrangement, once the two free ends of dumbbell fastener 46 have been secured to one another, handle 54 is securely nestled against back plate 31. While back plate 31 is shown as having two grooves, it is also within the scope of the present invention to include no grooves, one groove, or more than two grooves so long as dumbbell fastener 46 constrains handle 54 to bracket 30. Although not recommended due to safety concerns, it is further contemplated that no dumbbell fastener is used to secure dumbbell 50 within bracket 30 such that dumbbell 50 merely rests within the cradle of bracket 30.

A method for strength and weight training using a weight and a bar is also provided. The method including the steps of: providing a sleeve including a first end and a second end, the first end having a cap, and the second end being configured for receiving the bar; providing a generally J-shaped bracket pivotally mounted to the cap and adapted to secure the weight in the bracket; sliding the sleeve into the bar; securing the sleeve to the bar; and placing the weight within the bracket. An optional step is to secure the dumbbell within the bracket using a strap.

While the above assembly and method has been shown and described using dumbbells, it is envisioned that any suitably shaped weight may be used including kettlebells and the like.

The present invention provides a number of advantages that overcome the problems and deficiencies that exist with prior art barbell adapters. For example, one advantage provided by the present invention is the two piece assembly which allows the user to securely affix the sleeve to the bar. The sleeve does not travel or rotate on the bar and will not become dislodged from the bar during training exercises. The pivotally attached bracket with fastening strap securely holds the dumbbell within the cradle formed by the bracket, while the pivotal connection with the sleeve allows the dumbbell to freely pivot when the bar is being used. The pivotal connection secures the bracket to the sleeve such that the dumbbell remains secured to the bar throughout an exercise. Additionally, the two J-shaped brackets according to one aspect of the present invention allow a user to place the dumbbell within the bracket without impinging any fingers. The gap between the brackets also aids in removal of the dumbbell after exercising.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A dumbbell mounting assembly for releasably mounting a dumbbell on a bar, comprising:

a sleeve including a first end and a second end, said first end having a cap, said second end being configured for receiving the bar, wherein said cap has a threaded cap hole defined therein generally located along a longitudinal axis of said sleeve, and wherein said cap hole is adapted to receive a threaded fastening member; and a generally J-shaped bracket pivotally mounted to said cap and adapted to secure the dumbbell in said bracket, wherein said bracket has a bracket hole defined therein, and wherein said fastening member passes through said bracket hole and said cap hole to pivotally secure said bracket to said cap.

2. The dumbbell mounting assembly in accordance with claim 1, wherein said sleeve includes a through-hole defined therein for securing said sleeve to the bar.

3. The dumbbell mounting assembly in accordance with claim 2, wherein said through-hole is threaded and configured to receive a corresponding threaded fastening member, wherein said fastening member is adapted to contact the bar to secure said sleeve to the bar.

4. The dumbbell mounting assembly in accordance with claim 2, wherein the bar has a spring-mounted post adapted to be selectively received within said through-hole to secure said sleeve to the bar.

5. The dumbbell mounting assembly in accordance with claim 1, wherein said J-shaped bracket includes at least one base including a first end and a second end, wherein said first end of said at least one base is mounted to a back plate, and wherein said second end of said at least one base is mounted to at least one upright.

6. The dumbbell mounting assembly in accordance with claim 5, wherein said J-shaped bracket includes a first base and a second base, wherein said J-shaped bracket includes a first upright and a second upright, wherein said second end of said first base is mounted to said first upright, wherein said second end of said second base is mounted to said second upright, and wherein a gap is defined between said first base and said second base.

7. The dumbbell mounting assembly in accordance with claim 1, wherein said J-shaped bracket further comprises a fastener for securing the dumbbell in said bracket.

8. The dumbbell mounting assembly in accordance with claim 7, wherein said fastener is a strap releasably positioned through a groove defined in said J-shaped bracket.

9. The dumbbell mounting assembly in accordance with claim 8, wherein said strap is positioned around the dumbbell by at least one of the following: an adhesive, hook-and-loop fastener, clips, snaps, buttons, magnets and buckles.

10. A method for strength and weight training using a weight and a bar, the method including the steps of:

providing a sleeve including a first end and a second end, said first end having a cap, said second end being configured for receiving the bar, wherein said cap has a threaded cap hole defined therein generally located along a longitudinal axis of said sleeve, and wherein said cap hole is adapted to receive a threaded fastening member;

providing a generally J-shaped bracket pivotally mounted to said cap and adapted to secure the weight in said bracket, wherein said bracket has a bracket hole defined therein, and wherein said fastening member passes through said bracket hole and said cap hole to pivotally secure said bracket to said cap;

sliding said sleeve onto the bar;

securing said sleeve to the bar; and placing the weight within said bracket.

11. The method for strength and weight training in accordance with claim 10, further comprising the step of securing the weight within said bracket using a strap.

12. The method for strength and weight training of claim 11 wherein said strap is hook-and-loop material.

13. The method for strength and weight training in accordance with claim 10, wherein the weight is a dumbbell.

14. A dumbbell mounting assembly for releasably mounting a dumbbell on a bar, comprising:

a sleeve including a first end and a second end, said first end having a cap, said second end being configured for receiving the bar; and a generally J-shaped bracket pivotally mounted to said cap and adapted to secure the dumbbell in said bracket, wherein said J-shaped bracket includes at least one base including a first end and a second end, wherein said first end of said at least one base is mounted to a back plate, and wherein said second end of said at least one base is mounted to at least one upright; and a fastener including a first end and a second end, wherein said back plate includes a bottom groove and a top groove defined therein, and wherein said fastener is configured to be positioned within said bottom groove and said top groove so that the dumbbell is secured in said bracket when said first and second ends of said fastener are secured to one another.

15. The dumbbell mounting assembly in accordance with claim 14, wherein said first end and said second end include corresponding fastener materials selected from the list consisting of: an adhesive, hook-and-loop fastener, clips, snaps, buttons, magnets and buckles.

16. The dumbbell mounting assembly in accordance with claim 1, wherein said cap is integrally formed with said sleeve.

17. The dumbbell mounting assembly in accordance with claim 14, wherein said bracket is pivotally mounted to said cap by a rivet.

18. The dumbbell mounting assembly in accordance with claim 14, wherein said cap has a threaded cap hole defined therein generally located along a longitudinal axis of said sleeve, wherein said cap hole is adapted to receive a threaded fastening member, wherein said bracket has a bracket hole defined therein, and wherein said fastening member passes through said bracket hole and said cap hole to pivotally secure said bracket to said cap.

19. The dumbbell mounting assembly in accordance with claim 14, wherein said sleeve includes a through-hole defined therein for securing said sleeve to the bar.

20. The dumbbell mounting assembly in accordance with claim 19, wherein said through-hole is threaded and configured to receive a corresponding threaded fastening member, wherein said fastening member is adapted to contact the bar to secure said sleeve to the bar.

21. The dumbbell mounting assembly in accordance with claim 19, wherein the bar has a spring-mounted post adapted to be selectively received within said through-hole to secure said sleeve to the bar.

* * * * *